US007021077B2

(12) United States Patent
Schroeder

(10) Patent No.: US 7,021,077 B2
(45) **Date of Patent: *Apr. 4, 2006**

(54) BEVERAGE DISPENSING WITH COLD CARBONATION

(75) Inventor: Alfred A. Schroeder, San Antonio, TX (US)

(73) Assignee: Lancer Partnership Ltd., San Antonio, TX (US)

( * ) Notice: Subject to any disclaimer, the term of this patent is extended or adjusted under 35 U.S.C. 154(b) by 315 days.

This patent is subject to a terminal disclaimer.

(21) Appl. No.: 10/674,158

(22) Filed: Sep. 29, 2003

(65) Prior Publication Data

US 2004/0065680 A1 Apr. 8, 2004

Related U.S. Application Data

(63) Continuation of application No. 10/301,479, filed on Nov. 21, 2002, now Pat. No. 6,626,005, which is a continuation of application No. 09/961,668, filed on Sep. 24, 2001, now Pat. No. 6,574,981.

(51) Int. Cl.
*B01F 3/04* (2006.01)
*F25C 1/18* (2006.01)

(52) U.S. Cl. ..... 62/306; 62/390; 222/146.6

(58) Field of Classification Search ..... 62/306, 62/304, 389, 390; 222/146.6
See application file for complete search history.

(56) References Cited

U.S. PATENT DOCUMENTS 3,565,405 A 2/1971 Black
3,578,214 A 5/1971 Ianelli
4,629,589 A 12/1986 Gupta et al.
4,754,609 A 7/1988 Black
4,839,107 A 6/1989 Rudick et al.
4,979,647 A 12/1990 Hassell
5,139,708 A 8/1992 Scott
5,319,947 A 6/1994 Fischer
5,335,819 A 8/1994 Martin
5,350,086 A 9/1994 Martin et al.
5,392,960 A 2/1995 Kendt et al.
5,411,179 A * 5/1995 Oyler et al. ..... 222/129.1
5,417,147 A 5/1995 Mason
5,419,461 A 5/1995 Goulet
5,443,763 A * 8/1995 Notar et al. ..... 261/140.1
5,450,882 A * 9/1995 Cragun ..... 141/9
5,487,492 A 1/1996 Goulet
5,524,452 A * 6/1996 Hassell et al. ..... 62/389
5,624,645 A 4/1997 Malley
5,727,421 A * 3/1998 Murphy ..... 73/304 R
5,765,726 A * 6/1998 Jones ..... 222/129.1
5,836,481 A * 11/1998 Strohmeyer et al. ..... 222/182
6,152,325 A 11/2000 Edwards
6,220,047 B1 * 4/2001 Vogel et al. ..... 62/342
6,463,753 B1 10/2002 Haskayne
6,550,642 B1 * 4/2003 Newman et al. ..... 222/39
6,626,005 B1 * 9/2003 Schroeder ..... 62/306

FOREIGN PATENT DOCUMENTS

EP 0 165 792 A1 6/1985
EP 0 585 121 A2 8/1993

* cited by examiner

*Primary Examiner*—William E. Tapolcai

(57) ABSTRACT

Methods and apparatus for cold carbonation are provided in which a carbonator (13) having one or more segments is provided. A sensor (14) is provided that can be accessed from a side of a dispenser (10).

16 Claims, 7 Drawing Sheets

FIG. 8
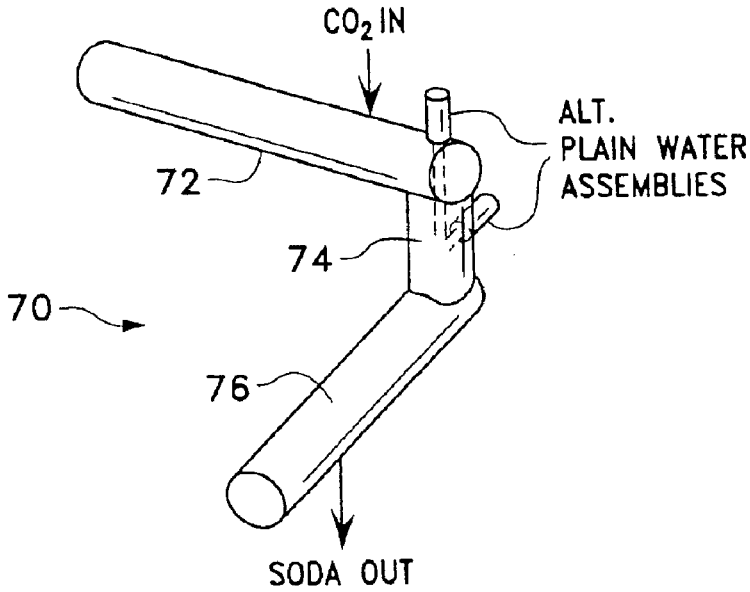
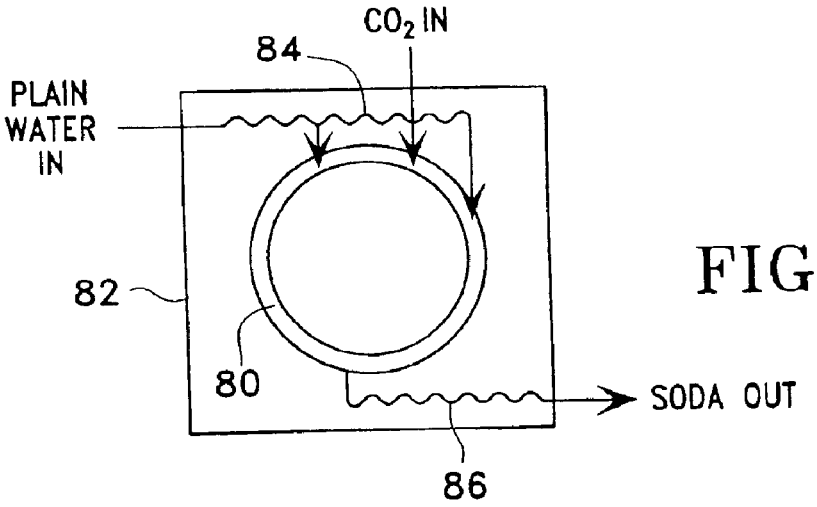
FIG. 9
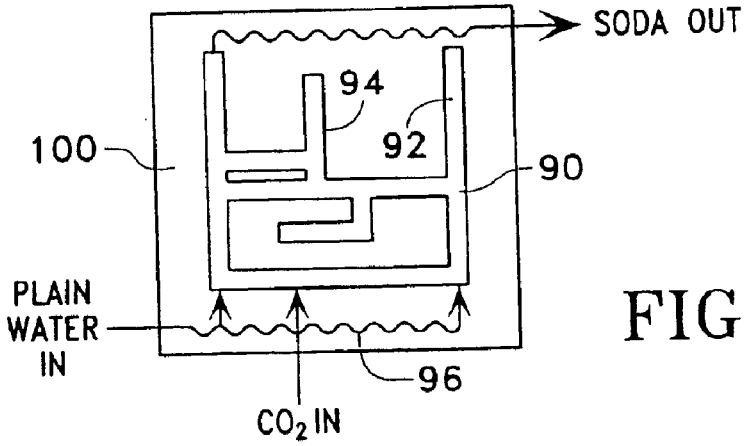
FIG. 10

BEVERAGE DISPENSING WITH COLD CARBONATION

CONTINUING APPLICATION INFORMATION

This application is a continuation of U.S. patent application Ser. No. 10/301,479, filed Nov. 21, 2002, entitled Beverage Dispensing With Cold Carbonation, now U.S. Pat. No. 6,626,005, which in turn is a continuation of U.S. patent application Ser. No. 09/961,668, filed Sep. 24, 2001, entitled Beverage Dispensing With Cold Carbonation, now U.S. Pat. No. 6,574,981.

TECHNICAL FIELD OF THE INVENTION

This invention relates generally to beverage dispensing, and in particular to methods and apparatus for beverage dispensing with cold carbonation.

BACKGROUND OF THE INVENTION

In "post-mix" beverage dispensing, beverage syrups are mixed with plain or carbonated water to form finished beverages. With respect to carbonated beverages, issues surrounding carbonation significantly affect the quality of the finished beverage.

For high quality beverages, for example, it is important that the specified carbonation level be consistently produced, regardless of system variations, such as ambient temperature. As another example, it is important that, in the dispensing of the finished product, foaming be minimized.

Efficient and cost-effective production of such high quality beverages is, of course, desirable. It has been discovered that lowering the temperature of water to be carbonated increases carbonation efficiency, and can allow for lower $CO_2$ pressures. Accordingly, prior art efforts have been made to increase carbonation efficiency by using colder water. For example, U.S. Pat. No. 4,754,609 discloses pre-cooling water before carbonation. As further examples, U.S. Pat. Nos. 5,319,947, 5,419,461, and 5,524,452 disclose chilled carbonators. However, significant improvements can be made to the efficiency, cost, and space utilization (among other aspects) of the prior art.

Therefore, a need has arisen for an improved beverage dispenser and methods that make use of cold carbonation.

SUMMARY OF THE INVENTION

In accordance with the teachings of the present invention, methods and apparatus for beverage dispensing with cold carbonation are provided that substantially eliminate or reduce problems associated with prior art systems.

A dispenser is provided that includes a cold source (such as a cold plate or an ice/water bath) and a carbonator that comprises one or more conjoined segments located substantially within the cold source. The conjoined segments may form a continuous or discontinuous hollow structure.

In a particular embodiment, a carbonator is provided that includes a toroidal tank, a water inlet, a carbon dioxide inlet, and a sensor for measuring water level within the tank. The tank may form a continuous or discontinuous structure.

Furthermore, a dispenser is provided that has a first side, and includes a cold plate, a carbonator at least partially within the cold plate, and a sensor coupled to the carbonator, the sensor being accessible from the first side of the dispenser. In a particular embodiment, the first side is the front side of the dispenser at which beverages are dispensed.

Also provided is a dispenser having a horizontal plane, the dispenser including a cold plate, and a carbonator at least partially within the cold plate, the carbonator being tilted with respect to the horizontal plane.

Also provided is a carbonator that includes a first tank section, a second tank section, and a third tank section. The first and third sections are coupled with the second section, the third section extending outward from said second section.

In particular embodiments, a dispenser includes a substantially flat carbonator tank and a substantially horizontal cold plate, with the carbonator tank located substantially within the cold plate. Also, the dispenser may include a plurality of water inlets into the carbonator tank. Also, the dispenser may include a probe assembly substantially parallel to the carbonator tank.

Methods of carbonating water are also provided, including a method of carbonating water that comprises providing a carbonator tank within a cold plate, injecting carbon dioxide into the tank, chilling water, injecting the chilled water into the tank, and chilling soda received from the tank.

With each of the embodiments, a pre-carbonation chilling circuit may be coupled to the carbonator. Similarly, a post-carbonation chilling circuit may be coupled to the carbonator.

An important technical advantage of the present invention is that it greatly improves carbonation efficiency by including a carbonator integrally formed with a cold plate.

Another important technical advantage of the present invention is the use of carbonation tank segments or toroid shapes to achieve geometries that provide efficient carbonation in small shapes.

Another important technical advantage of the present invention is the use of integral pre-carbonation cooling circuits and/or post carbonation cooling circuits.

Another important technical advantage of the present invention is the use of multiple water inlets to a cold carbonator. Still another important technical advantage of the present invention is its easy access to sensors for measuring water level in the carbonator.

BRIEF DESCRIPTION OF THE DRAWINGS

Reference is made in description to the following briefly described drawings, wherein like reference numerals refer to corresponding elements:

FIG. 8 illustrates another embodiment of a carbonator according to the teachings of the present invention;

FIG. 9 illustrates still another embodiment of a carbonator according to the teachings of the present invention;

FIG. 10 illustrates another embodiment of a carbonator according to the teachings of the present invention.

DETAILED DESCRIPTION OF THE INVENTION

Figure 1:
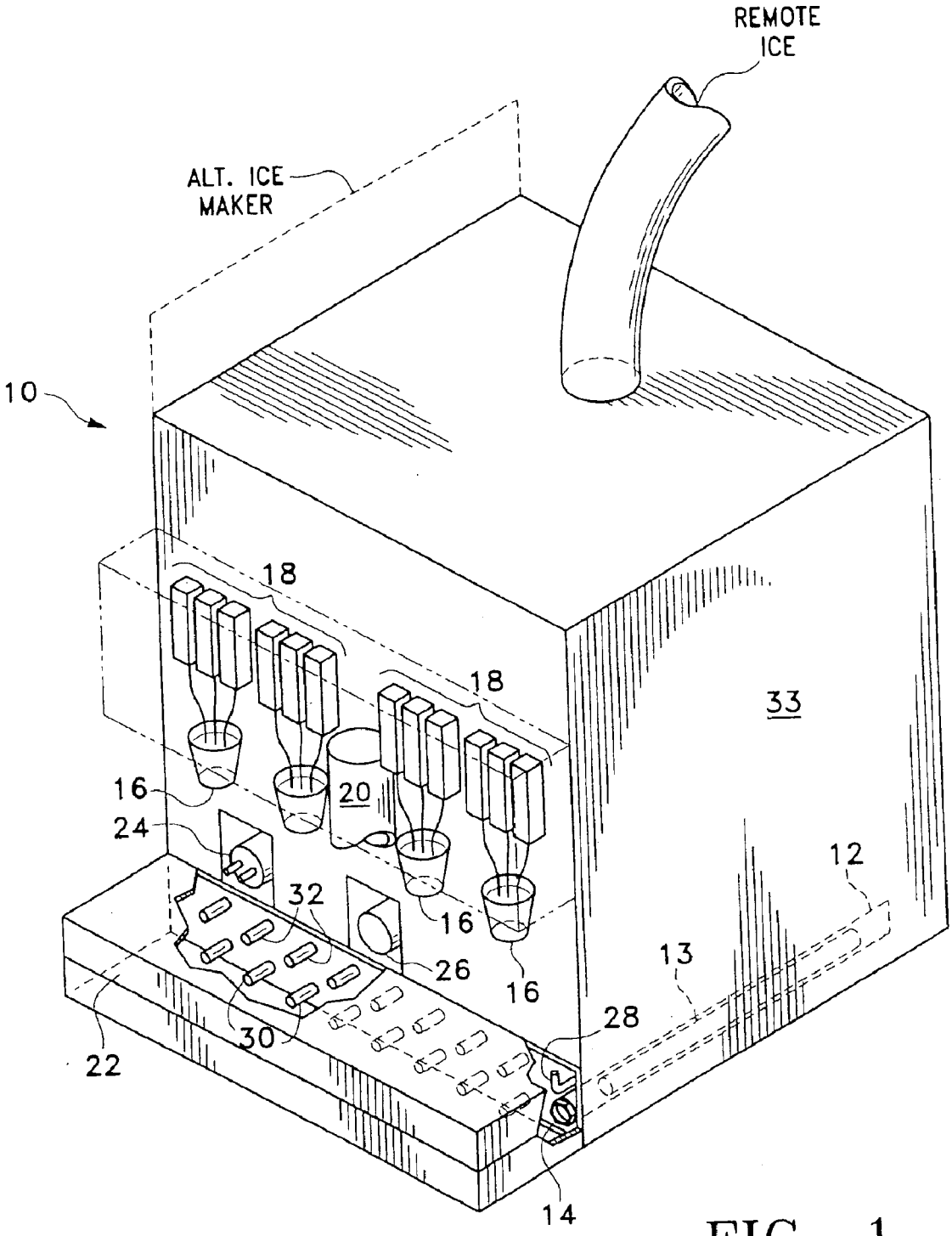
FIG. 1 is an illustration of a dispenser with cold carbonation according to the teachings of the present invention.

FIG. 1 illustrates a beverage dispenser 10 according to the teachings of the present invention. The particular dispenser 10 shown in FIG. 1 is adapted to be placed on the top of a counter and dispenses both beverages and ice. However, it should be understood that the present invention is not limited to this particular embodiment, and applies to all dispensers, including those that have areas underneath the counter, and whether or not they also dispense ice.

Included within dispenser 10 is a cold plate 12, a carbonator tank 13 within the cold plate 12, and carbonator probe assembly 14. The carbonator probe assembly 14 is used for measuring water levels within the carbonator 13, and is easily accessible through the front of dispenser 10. The cold plate 12 and probe assembly 14 may also be configured for access through the rear or sides of dispenser 10. Configuration of the probe assembly 14 for horizontal access is a significant improvement of the present invention over prior art systems, as it facilitates easy access for maintenance and repair.

Importantly, the carbonator tank 13 of one embodiment of the present invention is located within the cold plate 12, and is generally substantially horizontal in its orientation. This provides significant advantages. In particular, the carbonator probe assembly can be easily accessed, as discussed above. Also, the carbonation occurs at a low temperature, thus increasing carbonation efficiency and allowing for lower (and thus easier to work with) $CO_2$ pressures. With carbonation occurring in the cold plate, instead of without cooling, the carbonation level is substantially constant as ambient temperatures change, thus eliminating the need to change carbonation pressures in different seasons. Also, because carbonation occurs in the dispenser, installation and manufacturing are made easier as there is no separate carbonator. Similarly, asset tracking is made easier, and asset loss is reduced, as there is no separate carbonator to keep up with.

Furthermore, the relatively horizontally-oriented carbonator of one embodiment of the present invention, located substantially within the cold plate, provides significant advantages in that space is used very efficiently, in contrast to certain prior art attempts, where carbonators are located adjacent to or extend substantially from a relatively horizontal cold plate.

To achieve appropriate carbonation capacity, and to accommodate the other elements of the cold plate (cooling circuits for syrups and plain water), the geometry of the carbonator of the present invention is designed as one or more continuous or discontinuous tank segments. These segments allow room for the other cooling circuits. And, because of the relatively high surface area to volume ratio (thus efficient heat transfer) that results from using segments, very efficient carbonation is achieved.

Dispenser 10 also includes nozzles 16 through which finished products are dispensed. These nozzles mix either non-carbonated water (plain water) or carbonated water (soda) with beverage syrups and/or syrup flavors from valves 18 to produce finished beverages. The particular embodiment illustrates multiflavor nozzles 16 each coupled to a plurality of valves 18; however, single flavor setups are within the present scope. Ice chute 20 is also provided for dispensing ice. Drip tray 22 is positioned below the nozzles. In operation, finished products are dispensed into cups placed between the nozzles 16 and the drip tray 22.

The present invention also includes an integral pump 24 for pumping water to the carbonator tank 13. Also illustrated is motor 26, used to drive a mechanism for moving ice from the interior of the dispenser 10 to the ice chute 20, as will be discussed below in connection with FIG. 2.

It should be understood that, in a final dispenser, one or more cover plates are included to cover, from the user's view, items such as the valves 18, the pump 24, and the motor 26. However, such cover plates are easily removed (such as with a few screws), to facilitate easy maintenance. As shown, most of the elements of the dispenser 10 are located at the front of the dispenser, thus allowing for easy access and improved maintenance.

Removal of the drip tray 22 reveals the front of the cold plate 12, allowing easy access to the carbonator probe assembly 14. Also illustrated is $CO_2$ relief valve 28 and cold plate inlets 30 and outlets 32. Inlets 30 receive water and syrup to be chilled through the cold plate 12, and also water to be carbonated in the carbonator tank 13. The outlets 32 transmit chilled syrups and water (both plain and carbonated water) to the valves 18. The cold plate 12 is cooled with ice that can be manually dropped into ice bin 33 of the dispenser 10, or, alternatively, an icemaker can be placed atop or adjacent to the dispenser 10 to produce ice and convey it into the ice bin 33. As another alternative, a remote icemaker can be used to generate ice which can then be conveyed automatically, such as through a pneumatic tube, to the ice bin 33.

Figure 2:
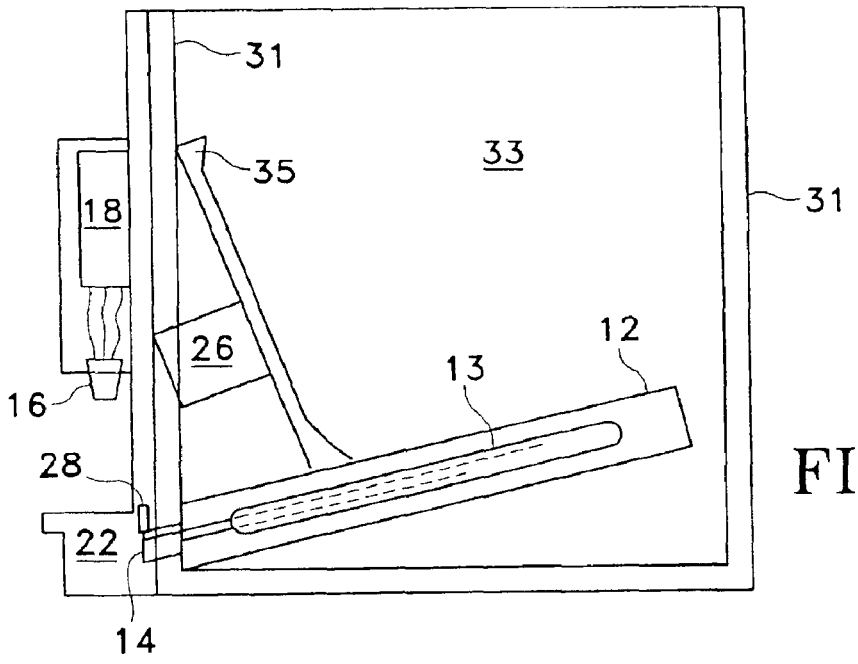
FIG. 2 is a side view of the dispenser shown in FIG. 1.

FIG. 2 shows a side cut away view of the dispenser 10 shown in FIG. 1. As shown in FIG. 2, the cold plate 12 includes integral carbonator 13. The carbonator probes of carbonator assembly 14 extend through the cold plate 12 and into the carbonator 13.

As shown in FIG. 2, the dispenser 10 includes insulation 31 surrounding the central ice bin 33 of the dispenser. The motor 26 drives a paddle wheel 35 used to convey ice from the ice bin to the ice dispenser chute 20. The paddle wheel conceptually shown in FIG. 2 is illustrative only, and other mechanisms may also be used. As discussed above, it should be understood that the cold plate of the present invention does not have to be used in connection with a dispenser that also dispenses ice.

In operation, ice cools the cold plate 12, which is formed from a conductive material, such as aluminum. Water and syrup are thus cooled as they flow through their respective water and syrup circuits within the cold plate 12. Importantly, the carbonator 13, and the water within the carbonator 13, are cooled in this same way, thus allowing for higher carbonation efficiency. With this higher carbonation efficiency, lower $CO_2$ pressures can be used, resulting in a more reliable, less expensive dispenser.

As shown in FIG. 2, cold plate 12 is tilted with respect to a horizontal plane of the dispenser 10. This tilting allows for the sensor of probe assembly 14 to more easily read changes in the water level, because, for some geometries, the more nearly horizontal the carbonator tank 30 and cold plate 12 are, the smaller the change in the water level is when soda is discharged from the carbonator tank 30. However, no such tilting is necessary. When, in this description, the carbonator 13 of the present invention is referred to as substantially, or relatively, horizontal, it includes orientations with some tilting. Also, the tilting can be accomplished by tilting the cold plate in which the carbonator tank is cast, or by tilting the carbonator within an otherwise horizontal cold plate.

Although any tilting angle can be used, preferably a tilting angle of less than about 20 degrees with respective horizontal plane is used.

Figure 3:
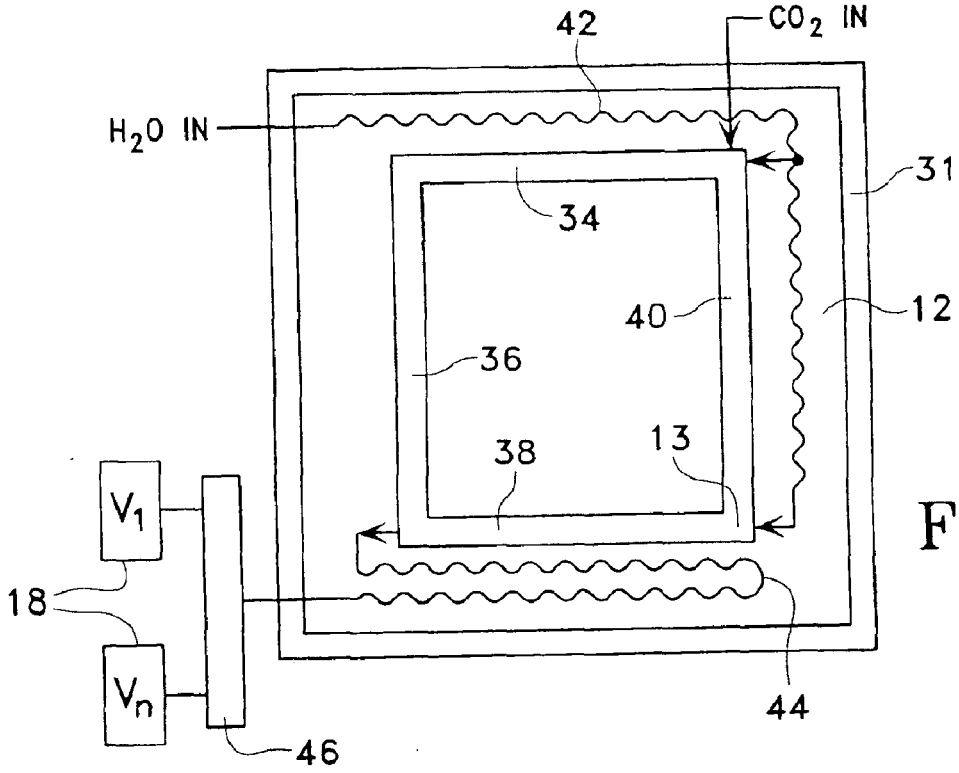
FIG. 3 is a schematic conceptual diagram of one embodiment of a cold plate with an integral carbonator according to the teachings of the present invention.

FIG. 3 illustrates a top view schematic of a cold plate 12 with integral carbonator 13 according to the teachings of the present invention. As shown in FIG. 3, carbonator tank 13 includes four conjoined segments 34, 36, 38, and 40. The cross section of any of these segments is preferably a circle, however any shape may be used. Similarly, the quadrilateral shape of carbonator tank 13 is exemplary only. Any shape can used that will provide the carbonation capacity required for the particular application. The particular geometric shape of the carbonator tank can be changed as desired to create the desired ratio of water to $CO_2$ headspace in the carbonator, and to accommodate the amount of space needed in the cold plate for plain water and syrup cooling circuits.

Although the particular carbonator 13 shown in FIG. 3 includes segments that are continuously connected, such continuous shapes are not required, and as will be discussed below in connection with other embodiments, one or more continuous or discontinuous segments can be used.

FIG. 3 also illustrates pre-chill circuit 42. Pre-chill circuit 42 allows plain water to be chilled before entering carbonator tank 13. In a preferred embodiment, the pre-chilled water is injected through a plurality of orifice blocks into the carbonator tank 13. However, only one injection point may also be used. Soda is conveyed from the carbonator tank 13 through one or more ports to a post-carbonation chilling circuit 44. This post-carbonation chilling circuit 44, like the pre-chill circuit 42, is preferably integrally formed within the cold plate 12. The post-chilled soda is then conveyed to a manifold 46 for transmission to the valves 18.

In a preferred embodiment, the pre-chill circuit 42 chills the plain water to approximately 40 degrees Fahrenheit. The post-chill circuit 44 chills the soda to a temperature in the range of preferably 34–40 degrees Fahrenheit. In addition to chilling the soda, the post-chill circuit 44 stabilizes the flow from the carbonator 13 into a less turbulent flow. Thus, more $CO_2$ remains in stream because of this more laminar flow, resulting in less foaming at dispense and higher carbonation (and therefore higher quality in the finished beverage product). However, it should be understood that either or both of the chilling circuits 42 and 44 may or may not be included as part of the present invention.

Figure 4:
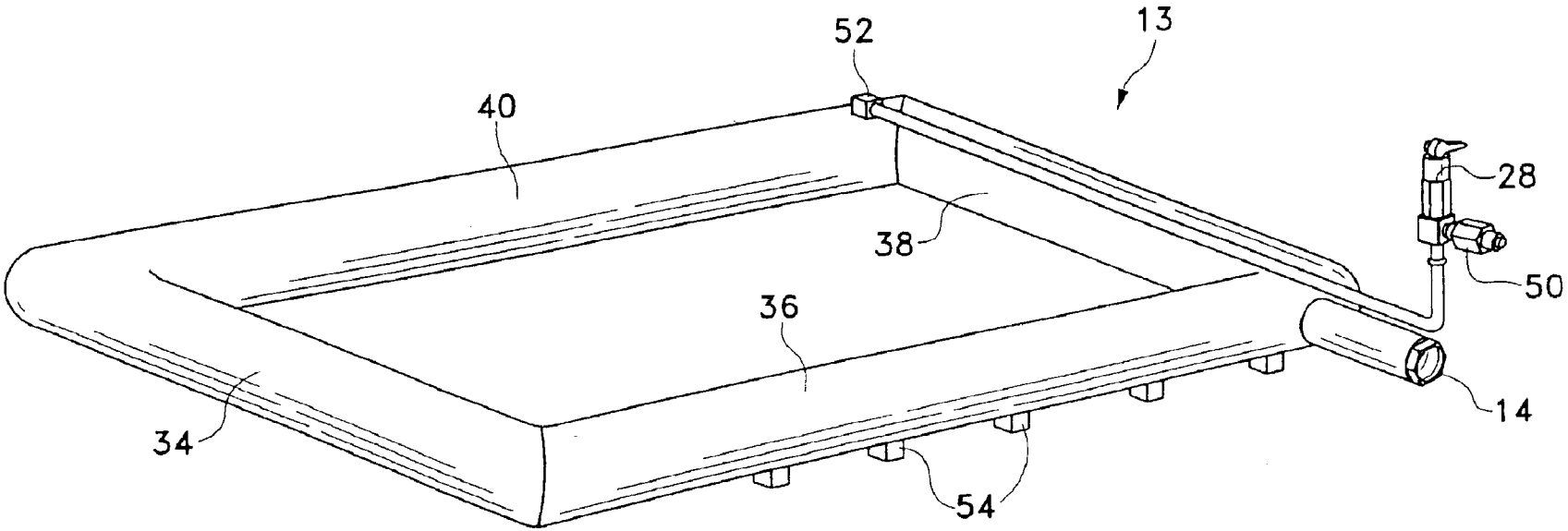
FIG. 4 illustrates one embodiment of a carbonator according to the teachings of the present invention.

FIG. 4 illustrates details of the carbonator tank 13 for the particular embodiment discussed in connection with FIG. 3. As shown in FIG. 4, $CO_2$ is supplied to the carbonator through fitting 50. Connected to fitting 50 is safety relief valve 28. The $CO_2$ is injected into the carbonator tank 13 at connection 52. Although only one connection 52 is shown, a plurality of injection points may be used. Soda is conveyed from the carbonator tank 13 through outlet fittings 54, which transmit the soda to the post cooling circuit 44 shown in FIG. 3.

Figure 5:
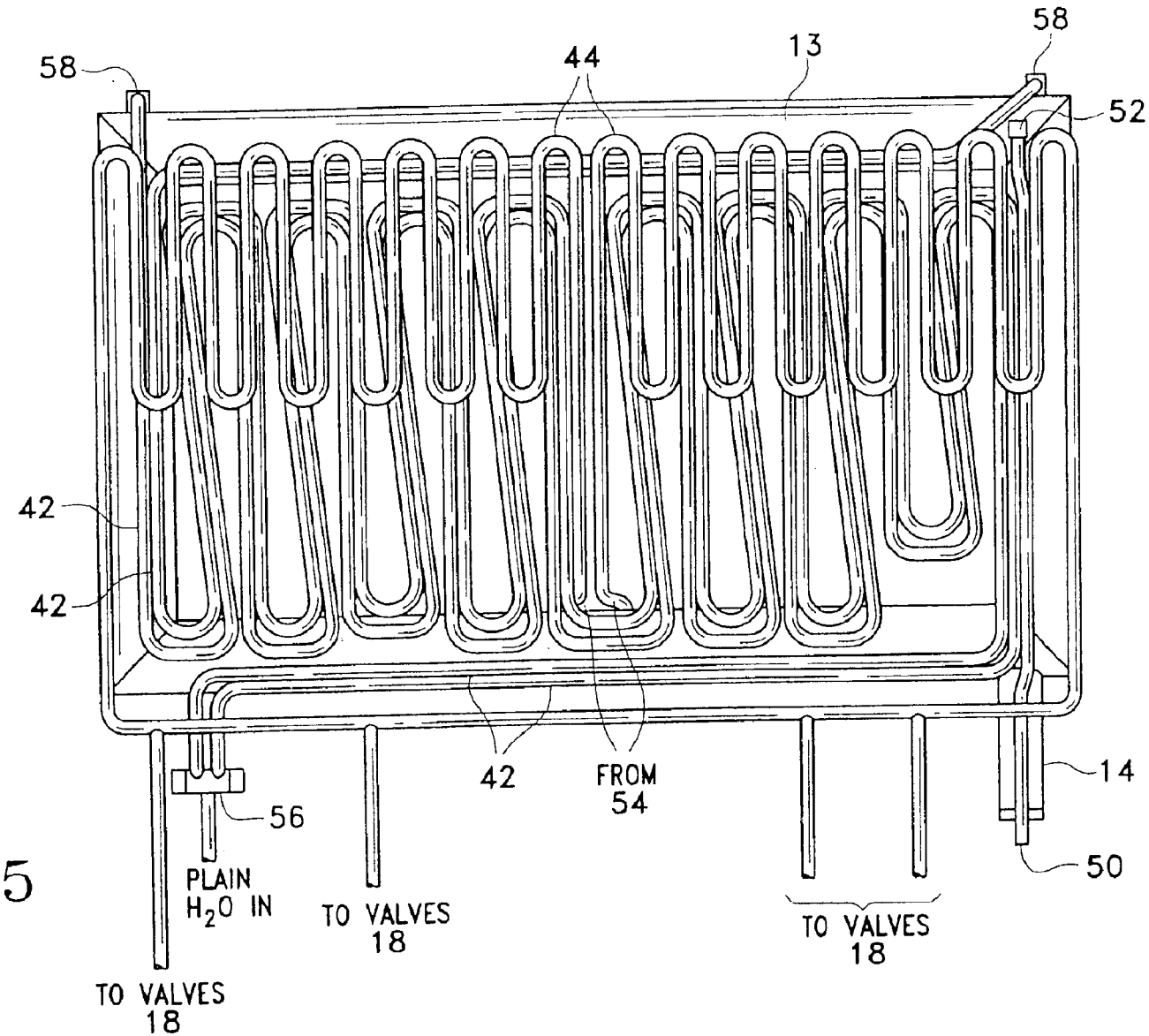
FIG. 5 illustrates a top view of one embodiment of a carbonator and pre- and post-carbonation chilling circuits according to the teachings of the present invention.

FIG. 5 illustrates the embodiment shown in FIGS. 3 and 4, with examples of pre- and post-chill circuits 42 and 44. As shown in FIG. 5, in a particular embodiment, two post-chill circuits 44 begin at the outlet connection points 54 and convey soda to the soda manifold 46. In the particular embodiment shown, two separate circuits 44 are shown, one beginning from each connection point 54. However, it should be understood that only one, or more than two, circuits may be used without departing from the intended scope of the present invention. Also shown in FIG. 5 are two pre-carbonation chilling circuits 42. These pre-carbonation chilling circuits 42 begin at a T-connection 56 that splits a single stream of plain water into two streams for the two separate chilling circuits 42. It should be understood, however, that only one, or more than two, circuits may be used without departing from the intended scope of the present invention. As discussed earlier, the pre-carbonation chilling circuits 42 cool the plain water before injection into the carbonator tank 13. The pre-chilled plain water is injected into the carbonator tank 13 at orifice blocks 58. In a particular embodiment shown, two orifice blocks 58 are used for generating two streams of water into the carbonator tank 13. The use of two streams improves efficiency over the use of a single stream by causing more turbulence within the carbonator tank. However, it should be understood that only one stream, or more than two streams, may be used without the departing from the intended scope of the present invention.

Figure 6:
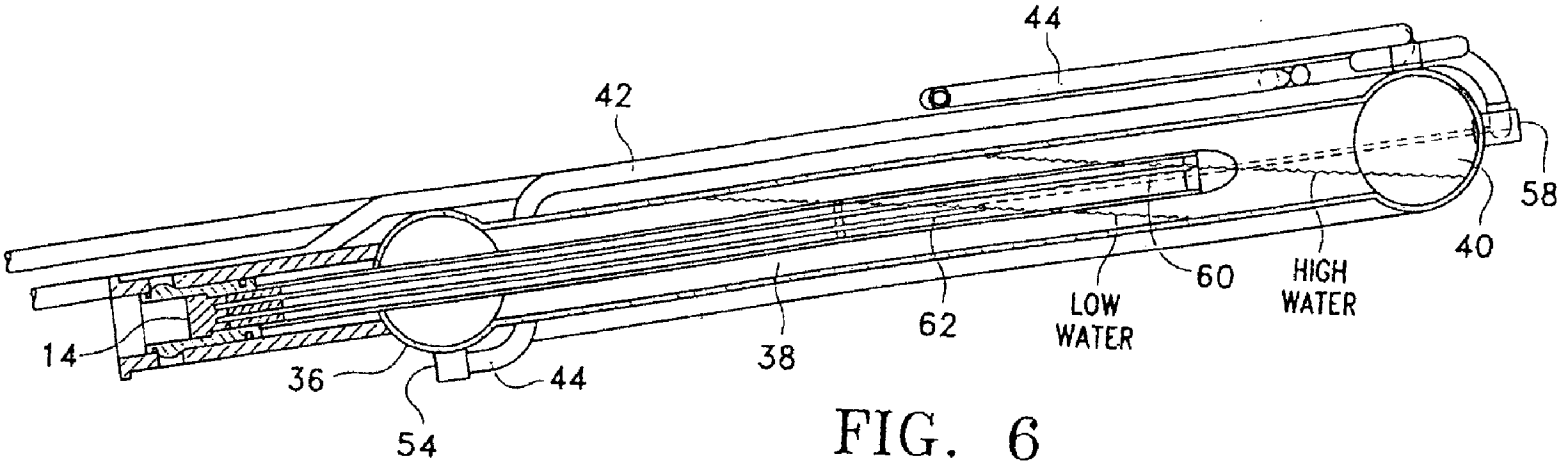
FIG. 6 illustrates a side view of one embodiment of a carbonator and carbonator probes according to the teachings of the present invention.
Figure 7:
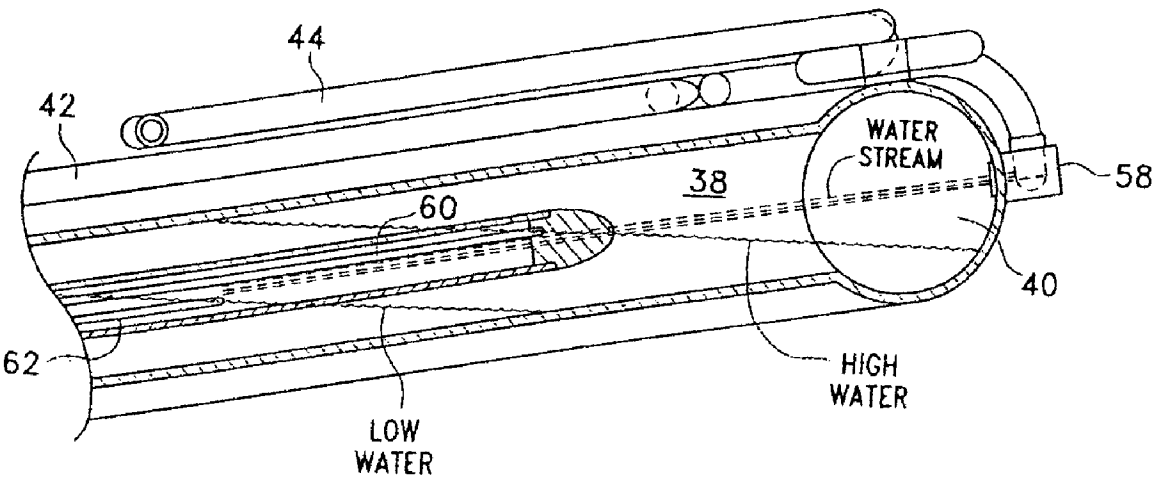
FIG. 7 illustrates a detail of the embodiment shown in FIG. 6.

FIGS. 6 and 7 show a side view of the carbonator tank 13 being discussed in connection with FIGS. 3–5. As shown in FIGS. 6 and 7, the plain water streams enter through orifice blocks 58 parallel to the segment 38 of the carbonator tank 13. However, it should be understood that other entry angles may be used without departing from the intended scope of the present invention. As is seen in FIGS. 6 and 7, the carbonator probe assembly 14 is an assembly that comprises two particular probes 60 and 62. These probes measure the water level within the carbonator 13 and are used to control the pump 24 that pumps plain water into the pre-chill circuits 42 and into the carbonator tank 13. In particular, when both probes 60 and 62 are under water (as designated by the high water level mark in FIGS. 6 and 7) the signals from the probes will be used to turn the pump 24 off. Similarly, if probes 60 and 62 are both uncovered, as shown by the low water level, then the pump 24 will be turned on to inject more plain water into the carbonator tank 13. Although probe assembly 14, with probes 60 and 62, is illustrated, any kind of sensor for measuring water levels may be used, including, without limitation, those that reside outside of the carbonator tank and measure the levels indirectly (such as, without limitation, ultrasound-based sensors).

The following descriptions of FIGS. 8, 9, and 10 illustrate that the present invention is not limited to any particular geometric shape or layout. In particular, continuous geometric shapes, such as toroids, or those formed with conjoined segments, may be used. Similarly, individual or conjoined segments that are not continuous may also be used. Also, embodiments with vertically displaced segments or sections can also be used.

The particular carbonator embodiments discussed to this point are substantially flat embodiments. However, the present invention may also be used with carbonator geometries that have segments that are vertically (with respect to the dispenser) displaced. Thus, as seen in FIG. 8, a particular carbonator 70 is illustrated that includes segments 72, 74, and 76. Segments 72 and segments 76 are joined through vertical segment 74. The water level can be measured in segment 74 (as well as in segments 72 and 76) with carbonator probes that are either parallel, perpendicular, or at some other angle to the segment 74. Plain water is preferably injected into segment 72 or 74 of the carbonator 70, but can also be injected into segment 76. Soda is receive out of the segment 76 and then sent to one or more post-chill circuits as discussed in connection with previous FIGUREs. Similarly, water injected into the carbonator 70 can be sent through one or more pre-chill circuits as discussed in connection with the previous embodiments. Also, the carbonator shown in FIG. 8 is preferably cast into a cold plate.

FIG. 9 illustrates a carbonator 80 that is in the shape of a toroid, cast into a cold plate 82. As discussed above in connection with the other embodiments, plain water is injected into the carbonator tank 80 through one or more inlet ports after being chilled through a pre-chill circuit 84. Similarly, soda is taken out of the carbonator tank 80 through a post-carbonation chill circuit 86. Although a toroid shape is shown in FIG. 9, other shapes can also be used, such as, without limitation, a single segment with an irregular shape (for example, like a snake), a single segment with a varying radius (for example a spiral or ovoid), and need not form a continuous hollow structure (for example, a "C" shape or spiral). For convenience, all such single segment shapes are referred to herein as toroids.

FIG. 10 illustrates a discontinuous carbonator tank 90 according to the teachings of the present invention. As shown in FIG. 10, carbonator tank 90 comprises a plurality of segments, some of which are joined but do not continuously join others. For example, segments 92 and 94 do not join together at their ends, but are stubs. Plain water is injected into carbonator tank 90 through inlet ports after being chilled through a pre-chill circuit 96. Also, soda is taken out of the carbonator tank 90 through a post-chill circuit 98. The carbonator tank 90, and pre-chill circuit 96 and post-chill circuit 98 are preferably integrally formed within cold plate 100.

Figure 11:
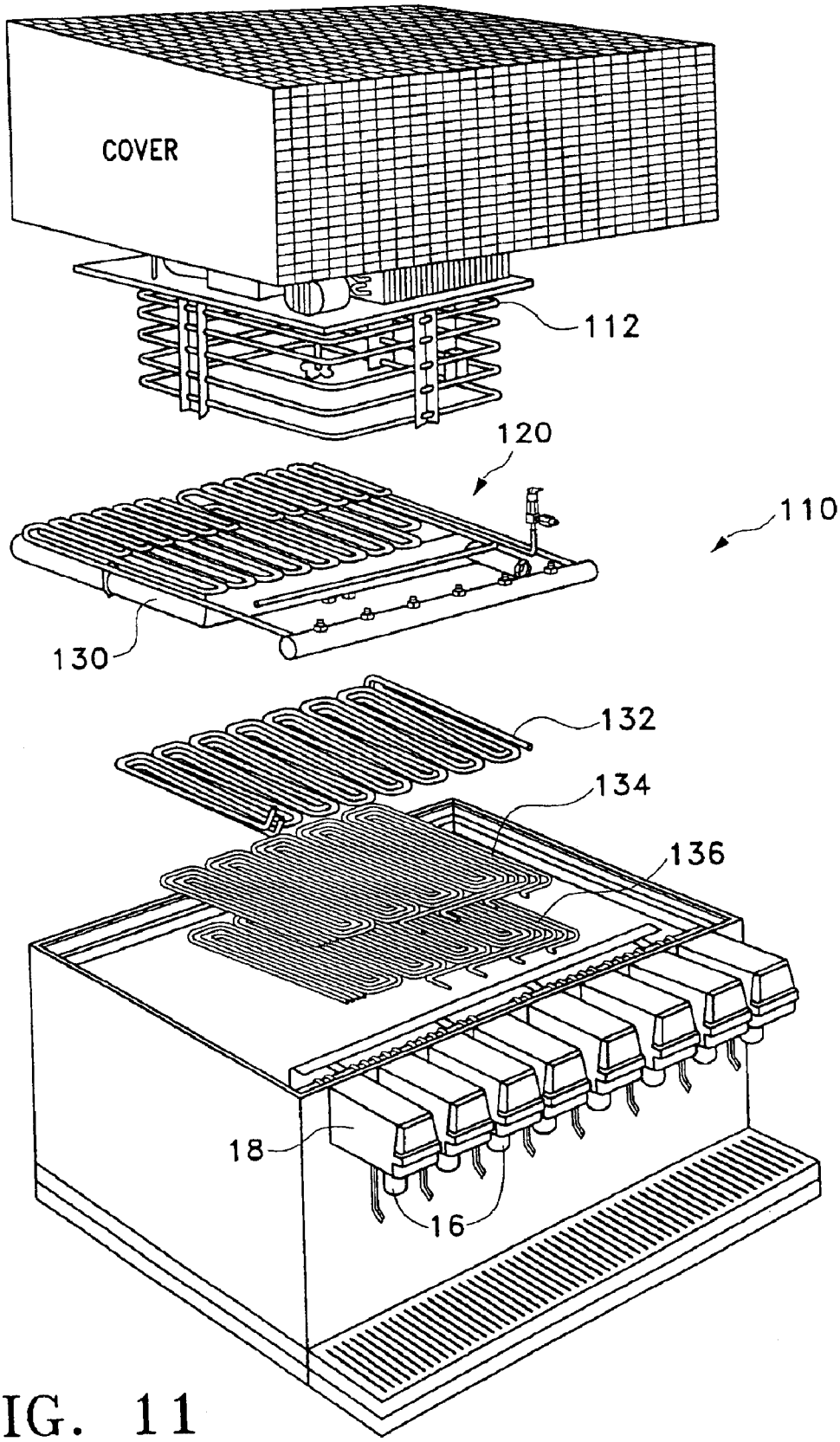
FIG. 11 illustrates one embodiment of cold carbonation in a mechanically cooled dispenser according to the teachings of the present invention.

FIG. 11 illustrates the dispenser 110 according to another embodiment of the present invention. Generally speaking, the teachings above apply to dispenser 110, except that rather than cooling with ice and a cold plate, dispenser 110 is cooled with a mechanical cooling unit, such as a vapor compression refrigeration unit 112. Refrigeration unit 112 generates an ice/water bath to cool the carbonator tank assembly 120. In the particular embodiment shown, the carbonator tank assembly 120 is similar to that shown above in connection with FIG. 5, and includes carbonator tank 130. Also shown in FIG. 11 are circuits 132, 134, and 136. These circuits are used for cooling syrup, or plain water for non-carbonated beverages. These circuits reside in the chilled water bath created by refrigeration unit 112. Although not illustrated in connection with previous embodiments, such syrup and plain water circuits are also used and cast in the cold plates discussed above in connection with the cold plate embodiments.

Although not shown, an electronic control system is also provided for controlling operation of the various embodiments dispensers discussed herein. The control system includes a microprocessor or micro-controller, and various input/output ports to effect the control. The control system interfaces with the carbonator probe assembly to determine, based on the carbonator water level, when to turn on and off the water pump that supplies the carbonator. Also, the control system interfaces with a customer interface for turning on valves to produce the desired beverage, and for dispensing ice, if included.

In this description, certain geometric shapes have been described in detail. However, it should be understood that these are illustrative examples, and other shapes can be used. Also, features described in connection with particular embodiments can be interchanged with features in other examples.

Although the present invention has been described in detail, it should be understood that changes, alterations, substitutions, additions, and modifications can be made without departing from the intended scope of the invention, as defined in the following claims.

What is claimed is:

1. A dispenser having a first side, wherein the first side is not a top or bottom side of the dispenser, comprising:

a cold source;

a carbonator;

a sensor coupled to the carbonator, the sensor sensing carbonator water levels; and an access space in the first side of the dispenser through which the sensor is accessible.

2. The dispenser of claim 1, wherein the first side comprises a front side of the dispenser at which beverages are dispensed.

3. The dispenser of claim 1, wherein the carbonator is positioned so that the sensor is removable through the access space.

4. The dispenser of claim 1, and further comprising a pre-carbonation chilling circuit coupled to the carbonator.

5. The dispenser of claim 1, and further comprising a post-carbonation chilling circuit coupled to the carbonator.

6. The dispenser of claim 1, and further comprising a pre-carbonation chilling circuit coupled to the carbonator and a post-carbonation chilling circuit coupled to the carbonator.

7. The dispenser of claim 1, wherein the carbonator is at least partially within the cold source.

8. The dispenser of claim 1, wherein the sensor comprises a probe assembly.

9. The dispenser of claim 1, wherein the cold source comprises a cold plate.

10. The dispenser of claim 9, wherein the carbonator is positioned so that the sensor is removable through the access space.

11. The dispenser of claim 10, wherein the carbanator is at least partially within the cold plate.

12. The dispenser of claim 1, wherein the cold source comprises an ice/water bath.

13. The dispenser of claim 12, wherein the carbonator is positioned so that the sensor is removable through the access space.

14. The dispenser of claim 13, wherein the carbonator is at least partially within the ice/water bath.

15. The dispenser of claim 1, wherein the sensor, in operation, is located at least partially within the carbonator, and wherein the sensor is removable from the carbonator through the access space.

16. The dispenser of claim 1, wherein the sensor, in operation, is located at least partially within the carbonator, and wherein the sensor is removable from the carbonator as it is removed through the access space.

* * * * *